US006338308B1

(12) United States Patent
Becker et al.

(10) Patent No.: US 6,338,308 B1
(45) Date of Patent: Jan. 15, 2002

(54) DEVICE FOR MOVING AND CONTROLLING THE KEELS OF SAILING YACHTS

(75) Inventors: Reinhard Becker, Monheim-Baumberg; Harald Engelmann, Potsdam, both of (DE)

(73) Assignee: Distancia Innovative Yachts GmbH, Monheim-Baumberg (DE)

( * ) Notice: Subject to any disclaimer, the term of this patent is extended or adjusted under 35 U.S.C. 154(b) by 0 days.

(21) Appl. No.: 09/594,392

(22) Filed: Jun. 15, 2000

(51) Int. Cl.[7] ..... B63B 41/00
(52) U.S. Cl. ..... 114/143; 114/136
(58) Field of Search ..... 114/143, 135–137, 114/126

(56) References Cited

U.S. PATENT DOCUMENTS 5,152,238 A * 10/1992 Page ..... 114/143

FOREIGN PATENT DOCUMENTS

| | | |
|---|---|---|
| DE | 2751364 | 5/1979 |
| DE | 2922629 | 12/1980 |
| DE | 8409661 | 9/1984 |
| DE | 9115019 | 8/1992 |
| DE | 29603893 U1 | 8/1996 |
| DE | 29817032 U1 | 2/1999 |
| EP | 0989056 A2 | 3/2000 |
| FR | 2 501 147 A * | 9/1982 |
| GB | 2 232 126 A * | 12/1990 |

* cited by examiner

*Primary Examiner*—Sherman Basinger
(74) *Attorney, Agent, or Firm*—Jordan and Hamburg LLP

(57) ABSTRACT

This invention provides a keel device for moving and controlling the keels of sailing yachts, in which each of the keels, which preferably are positioned one behind the other, can be swung out to either side by max. 90°. It is the object of the invention to provide the motion and control devices at the lowest point, so that their weight does not have to be balanced by additional ballast. Further, the device will not require installations inside the boat. The foregoing object is achieved in that the keel bomb includes right and left elements of motion arranged in pairs opposite each other, which are driven by a drive unit, the lift of which is transferred directly or via lifting systems to the power transmission devices located inside the keel shaft and are movable in the longitudinal direction. Under the hull of the boat are provided left and right joint systems for converting the longitudinal motion into a swiveling motion of the keel, which is directed either towards the right or left.

8 Claims, 4 Drawing Sheets

DEVICE FOR MOVING AND CONTROLLING THE KEELS OF SAILING YACHTS

BACKGROUND OF THE INVENTION

This invention pertains to a device for moving and controlling keels of sailing yachts, in which drive units are provided at a lowest point of the keels, wherein the keels preferably are positioned one behind another and are pivoted independently towards both sides.

From the objective of reducing the draft of sailing yachts in shallow waters and/or increasing their capsizing safety, it is known to fix keels under the hull of the boot, so as to be pivoted, while necessary drive units basically are located inside the boat. For example, DE 27 51 364, DE 84 09 661.6, DE 296 038 93, and DE 29 22 629 describe pivoted keels, which consist of two vertical separable components which, in case of need, can be expanded towards the outside at right angles to the mid-ship level. The drive and adjustable units can be housed either inside the body of the boat or immediately under the hull of the boat in a sealed "water zone". The water zone at its underside is provided with slots, through which pass brackets for the two expandable half-keels.

From German utility model G 91 15 019.1, a "lift keel device" is known which consists of a keel housing, which is provided with a shaft and a slide, which can be moved up and down hydraulically in the housing, at which slide the keel is fixed and from which the slide can be extended and retracted in the longitudinal direction, in which the required hydraulics are located directly in the keel housing immediately below the hull of the boat. This device does not enable a lateral swivel action of the keel.

The devices for swiveling or changing the length of the keels, which are characterized by the prior art and predominantly operate hydraulically, always have the disadvantage that they are provided either inside the hull of the boat, where they require a large space and represent an unmovable ballast, or are provided outside the keel joint to which shifts the center of gravity of the yacht, which must be balanced by a considerable extra ballast of the keel bomb. This may result in an unfavorable effect of sailing behavior which, in part, eliminates the advantages of swiveling keels. Moreover, the drive and power transmission devices must be provided at the time of constructing the boat, for they require a costly lead through the skin of the boat.

Moreover, the known devices are only suitable for moving the keel in one direction, towards the left or right, and up or down, which affects only a limited expansion of the boat's maneuverability.

SUMMARY OF THE INVENTION

In view of the foregoing, it is the object of the present invention to develop a device for moving and controlling keels, which can be swiveled towards both sides, the device being arranged at a lowest point of the keels and thus do not have to be balanced by additional ballast. Further, the device will not require installation inside the boat, so that the corresponding keels can be attached subsequently to any yacht.

According to an embodiment of the present invention, a device for moving and controlling the keels of sailing yachts, includes drive and power transmission devices, which are provided inside the keel/keels, wherein in the lowest component of the body of the keel are provided with a keel bomb portion having left and right elements of motion, which respectively are arranged in pairs. The elements of motion produce displacement which is transferred to power transmission devices, provided within a keel shaft portion disposed in the keel shaft, which move in a longitudinal direction of the keel shaft thereby producing longitudinal motion. Under a hull and connected there to is a keel joint portion provided with left and right joint systems for converting the longitudinal motion into a swiveling motion of the keel shaft portion, which is directed either towards the right or left.

The present invention further provides as a feature in the embodiment as described above, the lowest component of the body of the keel (keel bomb) including the elements of motion installed therein and the elements of motion including a drive unit of a hydraulic pump. In the disclosed embodiment two hydraulic pumps are respectively included in the elements of motion.

A further feature of the invention includes the power transmission device including two eccentric rods moving in the longitudinal direction.

Yet another feature of the invention includes the conversion of the longitudinal motion by the power transmission devices into the swiveling motion of the keel being effected by the keel joint portion having connecting rods respectively connected to the power transmission devices via lower connecting rod pivots, and a keel pivot is provided for pivoting the keel shaft portion.

The present invention further optionally provides the elements of motion and the power transmission devices being directly interconnected.

The present invention also optionally provides for right and left lever systems interconnecting the elements of motion and the power transmission devices.

In an embodiment of the present invention the right and left lever systems each include an upper scissors arm and a lower scissors arm connected by scissor pivot joints.

The present invention provides an embodiment wherein the connecting rods have upper connecting rod pivots that are fixable with respect to the hull of the boat and the lower connecting rod pivots are slidably supported on eccentric rods of the power transmission devices.

The present invention further provides for the keel joint portion having motion arrested by means of a mechanical safety mechanism when the perpendicular neutral position of the keel is reached and released once again hydraulically for swinging out once more.

The present invention also includes application of the above described device in several keels disposed one behind the other thus providing for a plurality of possibilities of improving a restoring moment, increasing capsizing safety, avoiding additional leeward drift and reducing draft that arise from the common perpendicular setting, opposite or parallel swinging out or different positions of each keel.

According to the invention, in the lowest components of a generally known keel, the keel including a keel joint, a keel shaft and a keel bomb, are provided with a drive unit for generating momentum, right and left momentum for generating motion and, in case of need, a lever system for transmitting the forces to other movable power transmission devices, which are located inside the keel in a longitudinal direction thereof. These power transmission devices terminate underneath the hull of the boat in the component designed as a keel joint portion where, according to the invention, up and down motion occurs in a right and left circular swiveling motion of the keel respectively up to max. 90° in each direction.

In a preferred embodiment, a generally known electrically driven hydraulic pump is used as drive unit. According to the invention, the lifting motion is provided by hydraulic cylinders, which serve as moving elements, and is transmitted directly or indirectly to power transmission devices provided inside the keel shaft, which, for example, can be designed as eccentric rods. When employing direct transmission, the hydraulic cylinders are connected directly with the eccentric rods. As an alternative, an indirect power transmission is effected via left and right lever systems, for example two scissors arms, which can be expanded from the hydraulic cylinders up to 180°. With both direct and indirect transmission in the keel joint, the maximum lift of the elements of motion results in the keel swinging out by max. 90°, in that the upward motion of the eccentric rods is transmitted via connecting rods and a sliding connecting rod hinge point at the right or left point of rotation of the keel.

The keel joint poriton has an arresting device for maintaining the keel in its perpendicular neutral position if no swinging out is required, and it also prevents the neutral position from overswinging.

BRIEF DESCRIPTION OF THE DRAWINGS

In the following is a brief description of the drawings.

DETAILED DESCRIPTION OF THE INVENTION

Figure 1A:
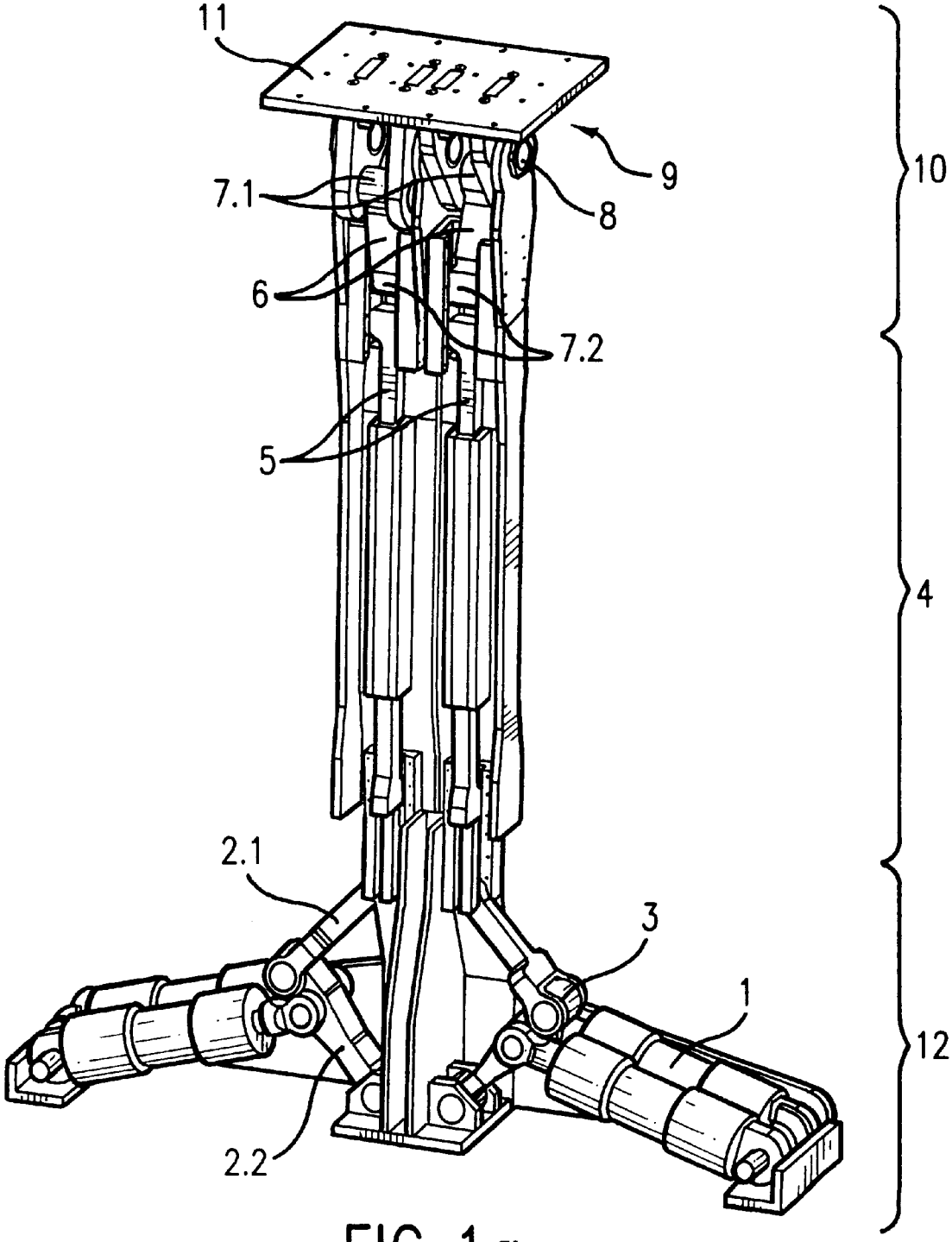
FIG. 1*a* shows a device of the present invention with an indirect transmission.
Figure 1B:
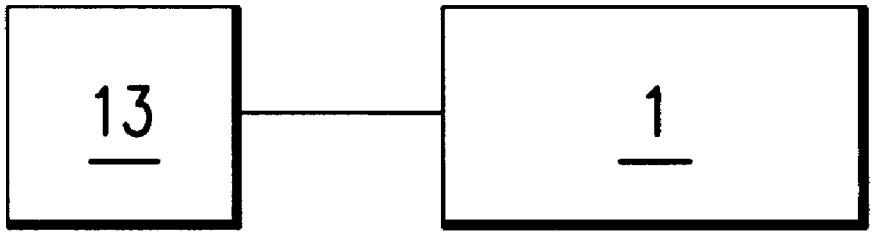
FIG. 1*b* shows a schematic block diagram of an interconnection of a cylinder and a hydraulic pump.
Figure 2A:
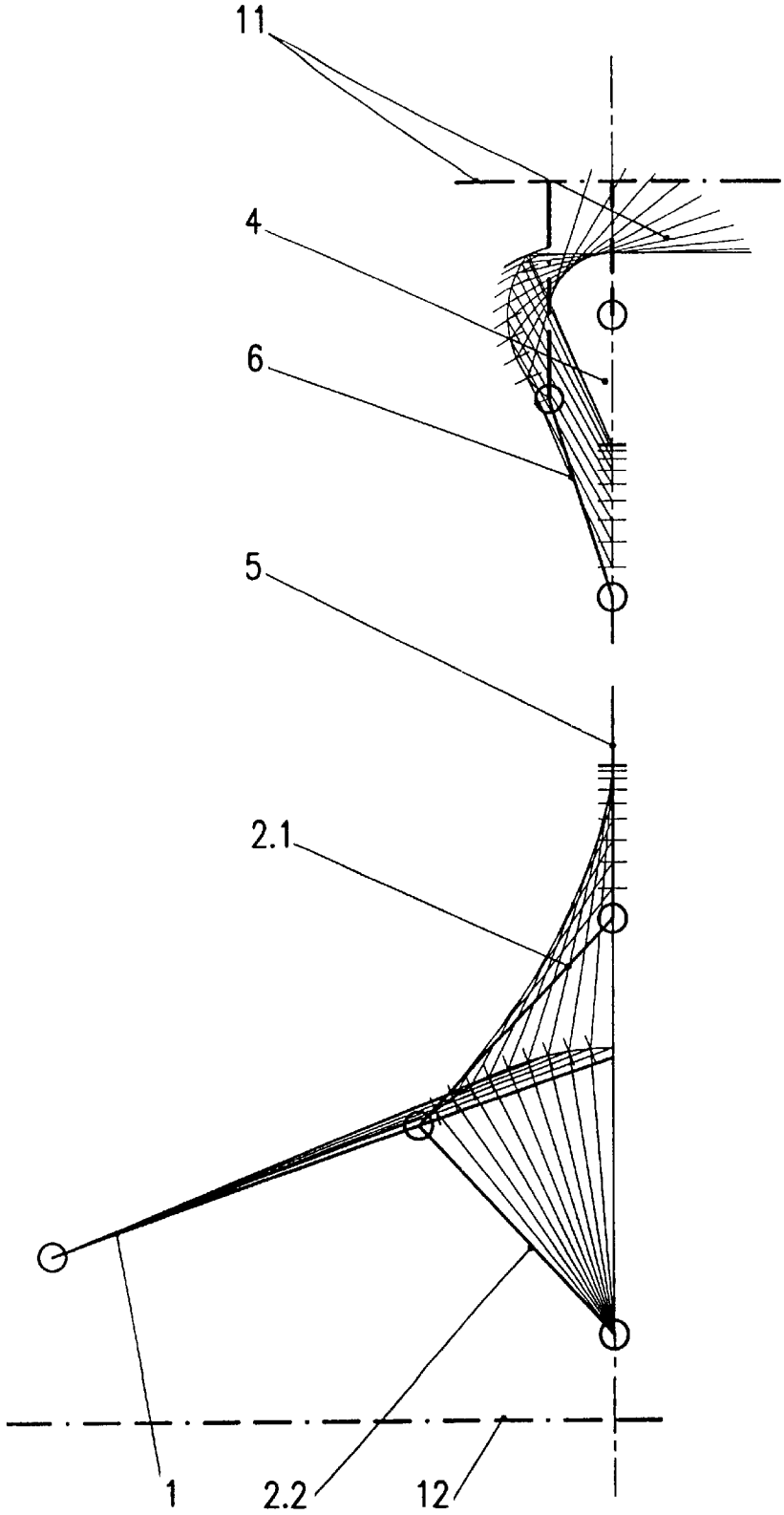
FIGS. 2*a* and 2*b* present the functions and motions (2*a* with indirect and 2*b* with direct transmission).
Figure 2B:
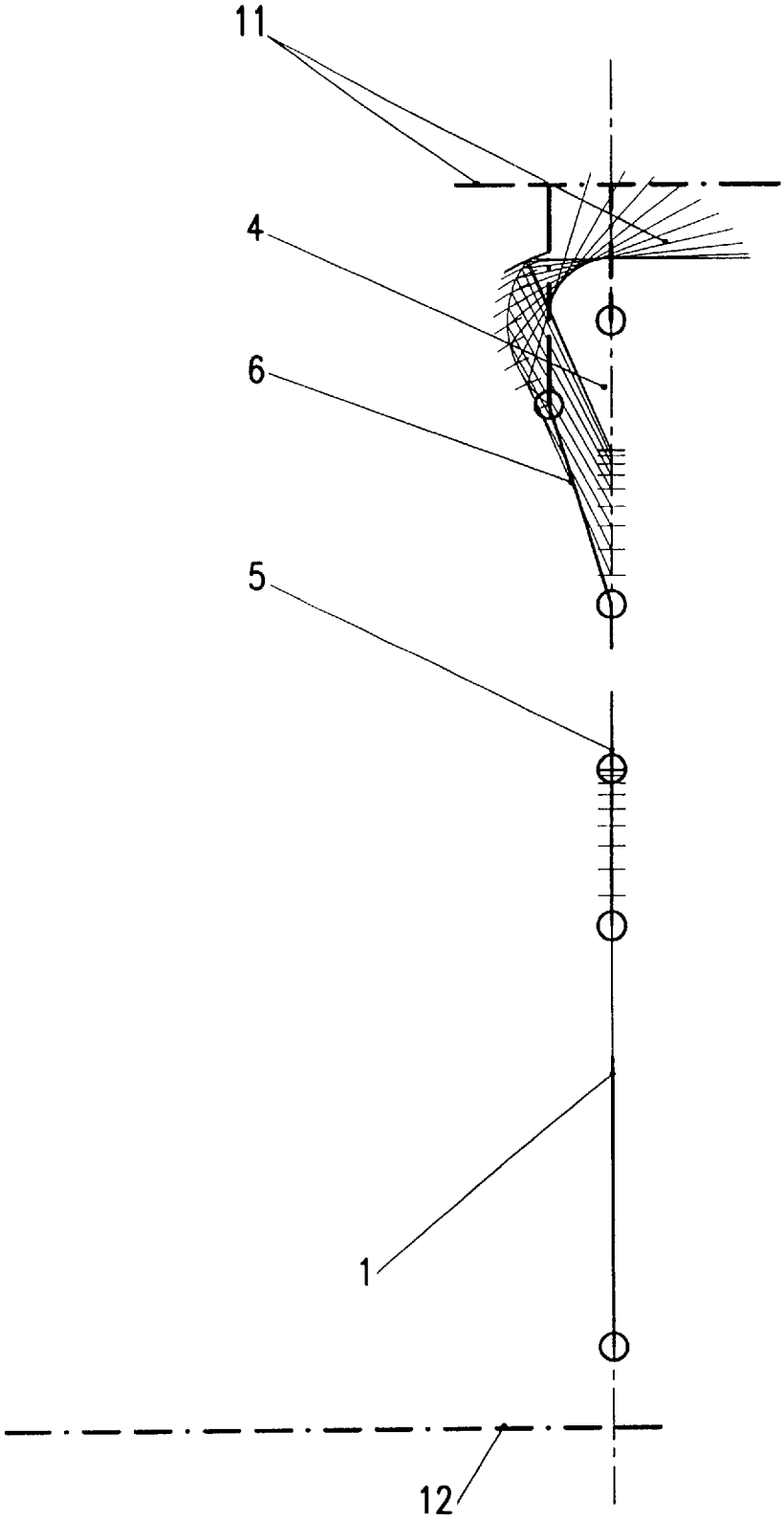

An embodiment of the present invention shown in an example described herein produces the following function sequence when swinging out a keel and during indirect power transmission: After starting a hydraulic pump 13, functionally shown in FIG. 1*b*, and upon achieving the necessary hydraulic pressure, a keel arrest device in the form of a mechanical safety mechanism 9 in a keel joint portion 10 is released. Depending on a direction of swing, a left or right hydraulic cylinder 1 begins to extend and push scissors arms 2.1, 2.2 apart up to a perpendicular line. The resulting lift is transmitted via one of eccentric rods 5, located in a keel shaft portion 4, to one of connecting rods 6. By fixing an upper connecting rod pivot point 7.1 to the hull of the yacht via basket plate 11, a perpendicular force is created in a lower pivot joint 7.2 of the connecting rod, which acts upon the keel. The force results into a swinging out of the keel about a keel pivot 8 of the keel, located in keel joint portion 10. With a maximal lift of the hydraulic pump 13 via cylinder 1, located in a keel bomb portion 12 which in turn is located in a keel bomb of the keel, the scissors arms 2.1, 2.2, connected by scissor pivot joint 3, are positioned perpendicular to each other, and the keel has reached a pivoting angle of 90°. Intermediate positions can be selected randomly via the corresponding lift of the hydraulic cylinder 1.

The return of the keel into the perpendicular neutral position is achieved mainly because of net weight of the keel bomb, in which a negligible restoring force of the approaching hydraulic cylinder ensures that the cylinder safely reaches a neutral position. The initially high restoring rate of the keel almost becomes zero when approaching the neutral position hydromechanically via a corresponding throttling of volume flow of hydraulic fluid. An automatic blocking of the keel arrest 9 prevents an overpivoting of the keel when reaching the neutral position. In order to swing out the keel in the opposite direction, a new pivoting operation must be initiated.

The keel device is a mechanism which is solid and rarely susceptible to trouble and subsequently can be mounted onto any yacht. In addition to a required supply of power, no installations are required inside the yacht. The sailing behavior of the boat is improved considerably by mounting the keel device into the components keel bomb and keel shaft, which is to be loaded with ballast, so that higher sailing speeds can be achieved. Depending upon requirement, the keel can be moved left or right, and swung out up to 90°.

For example, with two keels, being provided with the described keel devices one behind the other, different keel positions for improving the restoring moment, thereby increasing capsizing safety, avoiding additional leeward drift up to a minimum of 0.50 cm, by means of the perpendicular position of both keels, opposed swinging out of both keels between 0 . . . 90°, the swinging out of both keels towards one side, and the perpendicular position of a keel and the swinging out of a second keel.

If necessary, the boat may even be rested on the two keels, which swing out in opposite directions.

What is claimed is:

1. A device for moving and controlling for disposal in and control of a boat keel, the device comprising:

a keel bomb portion including left and right elements of motion respectively including pairs of drive devices for producing displacement;

a keel shaft portion including power transmission devices movable in a longitudinal direction by the displacement of the drive devices thereby providing longitudinal motion; and a keel joint portion, attachable to a hull of the boat, having left and right joint systems for converting the longitudinal motion of the power transmission devices into a swiveling motion of the keel shaft portion in port and starboard directions.

2. The device of claim 1, wherein the keel bomb portion is disposable in a lowest component of the keel and the right and left elements of motion include two hydraulic pumps.

3. The device of claim 1, wherein the power transmission device include two eccentric rods moving in the longitudinal direction.

4. The device of claim 1, wherein the conversion of the longitudinal motion by the power transmission devices into the swiveling motion of the keel is effected by the keel joint portion having connecting rods respectively connected to the power transmission devices via lower connecting rod pivots and a keel pivot is provided for pivoting the keel shaft portion.

5. The device of claim 4, wherein the connecting rods have upper connecting rod pivots that are fixable with respect to the hull of the boat and the lower connecting rod pivots are slidably supported on eccentric rods of the power transmission devices.

6. The device of claim 1, wherein the elements of motion and the power transmission devices are directly interconnected.

7. The device of claim 1, further comprising right and left lever systems interconnecting the elements of motion and the power transmission devices.

8. The device of claim 7, wherein the right and left lever systems each include an upper scissors arm and a lower scissors arm connected by scissor pivot joints.

* * * * *